United States Patent [19]

Wagner et al.

[11] Patent Number: 4,565,611

[45] Date of Patent: Jan. 21, 1986

[54] AQUEOUS ELECTROLYTES AND METHOD FOR ELECTRODEPOSITING NICKEL-COBALT ALLOYS

[75] Inventors: Heinz Wagner, Hilden; Klaus Scharwaechter, Solingen; Monika Nee, Duesseldorf, all of Fed. Rep. of Germany

[73] Assignee: Gerhard Collardin GmbH, Cologne, Fed. Rep. of Germany

[21] Appl. No.: 729,314

[22] Filed: May 1, 1985

[30] Foreign Application Priority Data

May 9, 1984 [DE] Fed. Rep. of Germany ..... 3416993

[51] Int. Cl.[4] ..... C25D 3/56

[52] U.S. Cl. ..... 204/44.5

[58] Field of Search ..... 204/44.5, 123

[56] References Cited

U.S. PATENT DOCUMENTS

| | | | |
|---|---|---|---|
| 2,026,718 | 1/1936 | Weisberg et al. | 204/44.5 |
| 3,093,557 | 6/1963 | Cope et al. | 204/44.5 |
| 4,069,112 | 1/1978 | Harbulak | 204/44.5 |

FOREIGN PATENT DOCUMENTS

| | | | |
|---|---|---|---|
| 2450527 | 9/1982 | Fed. Rep. of Germany | 204/49 |
| 21579 | 2/1980 | Japan | 204/44.5 |

*Primary Examiner*—G. L. Kaplan

*Attorney, Agent, or Firm*—Ernest G. Szoke; Henry E. Millson, Jr.; Mark A. Greenfield

[57] ABSTRACT

A process and compositions for the electrodeposition of hard, tarnish-resistant, white shining nickel- and cobalt-containing coatings using aqueous acidic baths containing metal ions and boric acid and also, as shine promotor, an aliphatic aldehyde and an aromatic carbonyl compound and, optionally, wetting agents, wherein aqueous solutions containing nickel, cobalt and chloride ions and boric acid and having a pH-value of from 3.6 to 4.8 and a nickel to cobalt ion ratio of from 8:1 to 20:1 are prepared, an aqueous solution of an aliphatic aldehyde and an aromatic, water-soluble carbonyl compound in a quantitative ratio of from 20:1 to 50:1 is added as shine promotor, layers containing nickel and cobalt are electrodeposited onto base material suitable for nickel plating at a temperature of from 50° to 55° C. and at a cathodic current density of up to 7 $A.dm^{-2}$ using nickel and optionally, cobalt metal in a ratio by weight of from 5:1 to 10:1 as the anode material.

21 Claims, 1 Drawing Figure

Hardness and composition of the layers depending on current density

AQUEOUS ELECTROLYTES AND METHOD FOR ELECTRODEPOSITING NICKEL-COBALT ALLOYS

BACKGROUND OF THE INVENTION

1. Field of the Invention

This invention relates to aqueous, acidic electrolytes containing nickel and cobalt ions and boric acid and also, as shine promotor, an aliphatic aldehyde and an aromatic carbonyl compound for the electrodeposition of hard, tarnish-resistant, white shining alloy coatings.

2. Statement of Related Art

The electrodeposition of metals on metallic surfaces for various purposes, for example, for improving wear resistance, friction reduction or corrosion prevention or even for decorative purposes, has been known for some time. Another known fact which has long been utilized in practice is that alloy coatings of several metals sometimes have more favorable properties for a certain application than individual coatings of the same metals. In particular, physical properties, such as coefficient of friction, temperature resistance or even magnetic permeability, can be specifically improved by coating a metal surface with an alloyed metal layer.

In numerous technological fields, good results have been obtained with nickel-cobalt alloys because not only are they characterized by favorable physical properties, they can also be readily electrodeposited in any desired composition. Electroplating baths containing suitable nickel and cobalt salts, for example chlorides, sulfates or sulfamates, boric acid and other additives influencing the electrical conductivity of the bath and the solubility of the anode, are used for forming nickel-cobalt alloy coatings.

On the other hand, German application No. 2,450,527 describes aqueous acidic baths for the electrodeposition of nickel coatings which, in addition to nickel salts and boric acid, also contain a so-called shine promotor consisting of an aliphatic $C_1$–$C_4$ aldehyde and an aromatic compound containing a carbonyl group. However, nickel coatings such as these are attended by the disadvantage that, although their surface is light, it has a yellowish sheen, is sensitive to marring and tends to tarnish and has to be aftertreated, for example by chromium plating. In addition, the hardness of the electrodeposited coating is not always satisfactory.

DESCRIPTION OF THE INVENTION

Figure 1:
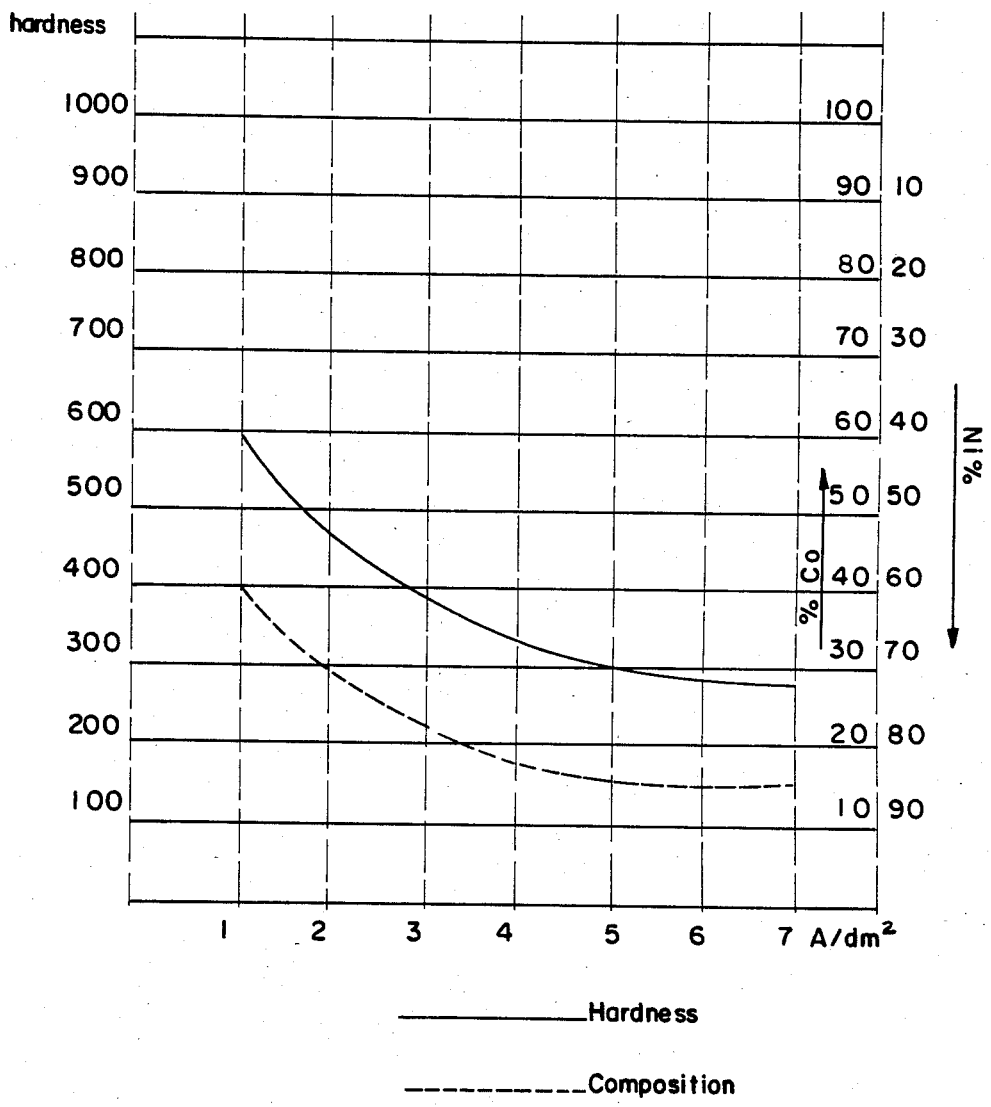
FIG. 1 is a graph which relates hardness of the deposited alloy and composition thereof to current density used during plating.

Other than in the operating examples, or where otherwise indicated, all numbers expressing quantities of ingredients or reaction conditions used herein are to be understood as modified in all instances by the term "about".

It has now surprisingly been found that the above-mentioned disadvantages do not arise if the bath used for electrodeposition is one which contains as electrolyte not only nickel salts, but also cobalt salts in conjunction with boric acid and with a shine promotor containing an aliphatic aldehyde and an aromatic carbonyl compound and, optionally, a wetting agent.

Accordingly, the present invention relates to a process for the electrodeposition of hard, tarnish-resistant, white shining, nickel- and cobalt-containing coatings using aqueous acidic baths containing metal ions and boric acid and also, as shine promotor, an aliphatic $C_1$–$C_4$ aldehyde, preferably formaldehyde, and an aromatic carbonyl compound, preferably o-benzoyl sulfimide or an N-acetyl derivative thereof and, optionally, wetting agents, wherein the process of the invention is carried out as follows:

(a) an aqueous bath solution is prepared having a pH-value of from 3.6 to 4.8, a nickel ion content of from 15 to 150 $g.l^{-1}$, a cobalt ion content of from 0.5 to 15 $g/l^{-1}$, a chloride ion content of from 5.0 to 25.0 $g.l^{-1}$, a boric acid content of from 20 to 40 $g.l^{-1}$, an aliphatic $C_1$–$C_4$ aldehyde content of from 0.1 to 1 $g.l^{-1}$, and an aromatic water-soluble carbonyl compound content of from 0.005 to 0.05 $g.l^{-1}$, wherein the ratio of dissolved nickel ions to dissolved cobalt ions is from 8:1 to 20:1, and the ratio of aldehyde to carbonyl compound is from 20:1 to 50:1, and (b) nickel- and cobalt-containing layers are electrodeposited using known methods onto base materials suitable for nickel plating using the bath prepared in (a) at a temperature of from 40° to 60° C. and at a cathodic current density of up to 7 $A.dm^{-2}$ using nickel and cobalt metal in a ratio by weight of from 5:1 to 10:1 as anode material.

The contents of the components in the bath solution (a) are adjusted to the levels set forth above as required by restrengthening with suitable freshening solutions.

The above bath solution (a) is preferably prepared by mixing together an aqueous solution containing all of the bath components except for the aldehyde and the carbonyl compound, with an aqueous shine promoter solution of the aldehyde and carbonyl compound. Obviously, however, it is not necessary to prepare separate solutions followed by mixing them together to form the electrodeposition baths of the invention, i.e., the electrodeposition bath (a) can be formed directly by adding all of the ingredients thereto. However, use of the above two solutions is the most convenient and practical method for forming the present electrodeposition baths.

The baths used for the process of the invention are suitable for the formation of hard, tarnish-resistant, white shining alloy coatings.

Preferred baths contain nickel ions in a quantity of from 36.0 to 93.3 $g.l^{-1}$, cobalt ions in a quantity of from 1.7 to 11.5 $g.l^{-1}$, chloride ions in a quantity of from 8.0 to 12.0 $g.l^{-1}$ and boric acid in a quantity of 30 $g.l^{-1}$. The contents of the individual components can be adjusted in known manner, for example by the addition of from 150 to 400 $g.l^{-1}$ of nickel sulfate heptahydrate, from 20 to 40 $g.l^{-1}$ of nickel chloride hexahydrate, from 8 to 55 $g.l^{-1}$ of cobalt sulfate heptahydrate and 30 $g.l^{-1}$ of boric acid. The baths have a pH-value of from 3.6 to 4.8, and preferably from 4.0 to 4.4.

The acidic electrodeposition baths may optionally contain an anionic wetting agent as an additional constituent. Particularly suitable wetting agents are $C_8$–$C_{18}$ alkyl sulfates or $C_8$–$C_{18}$ alkyl ether sulfates containing from 2 to 6 alkylene (preferably ethylene or propylene) oxide groups. Preferred optional wetting agents are isononyl sulfate and sodium lauryl ether sulfate. The wetting agents are used in quantities of from 0.1 to 2.0 $g.l^{-1}$ of the electrodeposition bath.

Electrodeposition (step (b) above) is carried out at a temperature of from 40° to 60° C. and preferably at a temperature of from 50° to 55° C. The cathodic current density may vary within wide limits, low cathodic current densities being used for drum electrodeposition and higher cathodic current densities for rack electrodeposition. The baths may be operated at current densities of up to 7 $A.dm^{-2}$.

The anode materials used are pieces of nickel and cobalt in a ratio by weight of from 5:1 to 10:1 in titanium baskets with anode bags. The nickel anode used may be of any material which may also be used for bright nickel plating.

The cobalt metal used for the anodes has to satisfy stringent purity requirements because it has a crucial effect on the quality of the white nickel deposits. Only metallic cobalt having a purity of at least 99.9% may be used herein. Impurities may be present only in the ppm-range. For example, a cobalt suitable for use as the anode material is one containing 1 ppm of arsenic, 10 ppm of copper, 15 ppm of iron, 3 ppm of lead, 2 ppm of zinc, 0.07% of nickel, 20 ppm of carbon, 2 ppm of hydrogen, 30 ppm of oxygen, 2 ppm of nitrogen and 2 ppm of sulfur.

Additionally, high purity requirements have to be satisfied by the cobalt sulfate used in the process of the invention. It is preferred to use chemically pure, crystalline cobalt (II) sulfate heptahydrate having a purity of at least 99%.

The nickel salts used have to comply at least with the requirements of DIN 50 970. Boric acid suitable for the process according to the invention has to be of electroplating quality, i.e. suitable for use in high-performance nickel plating baths.

Aliphatic aldehydes suitable for use as part of the shine promotor are, for example, formaldehyde, including paraformaldehyde, acetaldehyde, propionaldehyde and butyraldehyde.

The o-benzoyl sulfimide most suitable for use as the aromatic carbonyl compound is best used in the form of its alkali metal salt, preferably in the form of the sodium salt, for the shine promotor. Instead of o-benzoyl sulfimide, N-acetyl-o-benzoyl sulfimide can also be employed.

The two above-mentioned organic components for the shine promotor are mixed in a molar ratio of from 20:1 to 50:1 and stored in the form of an aqueous solution. To prepare the electrodeposition baths suitable for the process of the invention, the shine promoter solution is added to the electrolyte-containing aqueous solution in such a quantity that the concentrations of components are in the ranges given in (a) above.

In the practical application of the process of the invention, layers containing nickel and cobalt are electrodeposited on suitable substrate surfaces. The depletion of nickel and cobalt ions in the solution caused by the deposition is compensated by the successive passing into solution of the nickel and cobalt anodes. Provided the other process parameters remain constant, a constant content of nickel and cobalt ions is maintained in the baths.

In one variant of the process, only nickel anodes are used. In this case, the cobalt consumed during the electrodeposition process has to be replaced by the addition of cobalt sulfate heptahydrate in quantities of the order of 12 kg of $CoSO_4.7H_2O$ per 10,000 Ah (ampere hours).

The components of the shine promotor solutions suitable for use in forming the bath (a) are consumed in the course of the electrodeposition process. Accordingly, their content in the bath solutions has to be continuously monitored and adjusted as required to the levels indicated by restrengthening with shine promotor solutions. Coatings containing nickel and cobalt on metallic surfaces or on plastic workpieces pretreated by known methods are obtained by the process described above. The composition of the electrodeposited, white shining alloy coatings depends largely on the cathodic current density applied and on the ratio between the nickel and cobalt ions in the electrolyte. Coatings containing from 60 to 84% by weight of nickel and from 16 to 40% by weight of cobalt are obtained. In this connection, relatively low cobalt contents and high nickel contents usually occur at high current densities and relatively high cobalt and lower nickel contents at low current densities. The dependence of the coating composition on the cathodic current density is shown in FIG. 1.

The metal coatings obtained by the process of the invention are distinguished by high tarnish resistance and an excellent corrosion-inhibiting effect. By virture of the cobalt present in them, these coatings are harder than electrodeposited bright nickel coatings. They also show a high shine which extends to a considerable depth. By virtue of these outstanding properties, the process of the invention can be used anywhere where decorative or decorative and functional coatings are required as the final coating, for example as a substitute for bright chromium-after-nickel plating, as the final coating in two-layer or three-layer nickel deposits or in the electroplating of bulk ware. In addition, the process is used for obtaining special surface effects, for example for imitating a polished aluminium surface on plastic articles.

The cathode efficiency is of the same order as in known semi-bright and bright nickel plating baths.

The invention is illustrated but not limited by the following Examples.

A: Examples 1 to 6 and Comparison Examples C1 to C4

Electrodeposition baths containing the components set forth in Table 1 in the quantities given therein were prepared. A shine solution having the following composition 8.0% by weight of formaldehyde,
0.1% by weight of sodium o-benzoyl sulfimide
21.8% by weight of sodium lauryl ether sulfate and
70.1% by weight of water was added to these electrolyte baths as a shine promotor in the quantities set forth in Table 1, penultimate column. The cathode plates used for the following electroplating process were polished brass plates which were mechanically moved in the electroplating bath. The anode consisted of metallic nickel and metallic cobalt of high purity in titanium baskets with anode bags. The brass plates were electrocoated in known manner for 10 minutes at a temperature of from 55° to 60° C.

The coatings containing nickel and cobalt metal deposited on the cathode are characterized in Table 2.

TABLE 1

| Example[a] | $NiSO_4 \cdot 7H_2O$ | $NiCl_2 \cdot 6H_2O$ | Ni | $CoSO_4 \cdot 7H_2O$ | Co | Ni:Co | $H_3BO_3$ | Shine solution (ml/l) | Current density ($A \cdot dm^{-2}$) |
|---|---|---|---|---|---|---|---|---|---|
| | Quantities of components in the electrodeposition baths ($g.l^{-1}$) and current density applied for electrodeposition | | | | | | | | |
| 1 | 300 | 30 | 70.12 | 35 | 7.34 | 9.6:1 | 30 | 6 | 3 |
| 2 | 150 | 30 | 38.8 | 17.5 | 3.7 | 10.5:1 | 30 | 6 | 3 |
| 3 | 75 | 30 | 23.1 | 8.8 | 1.9 | 12.2:1 | 30 | 6 | 3 |
| C1 | 75 | 30 | 23.1 | 8.8 | 1.9 | 12.2:1 | 30 | 6 | 10 |
| C2 | 37.5 | 30 | 15.3 | 4.4 | 0.9 | 17:1 | 30 | 6 | 10 |
| 4 | 37.5 | 30 | 15.3 | 4.4 | 0.9 | 17:1 | 30 | 6 | 0.5 |
| C3 | 400 | 30 | 91.0 | 45.0 | 9.4 | 9.7:1 | 30 | — | 7 |
| 5 | 400 | 30 | 91.0 | 45.0 | 9.4 | 9.7:1 | 30 | 12 | 7 |
| 6 | 500 | 30 | 119.9 | 55.0 | 11.6 | 9.7:1 | 30 | 18 | 5 |
| C4 | 500 | 30 | 119.9 | 55.0 | 11.6 | 9.7:1 | 30 | — | 5 |
| 7 | 300 | 30 | 70.12 | 35 | 7.34 | 9.6:1 | 30 | 2 | 6 |
| C5 | 300 | 30 | 70.12 | 35 | 7.34 | 9.6:1 | 30 | — | 6 |
| 8 | 300 | 30 | 70.12 | 35 | 7.34 | 9.6:1 | 30 | 0.5 | 0.5 |
| 9 | 300 | 30 | 70.12 | 35 | 7.34 | 9.6:1 | 30 | 6 | 5 |

Note: [a]Examples preceded by "C" are Comparison Examples (eg. C2)

TABLE 2

| Example[a] | Characterization of the products<br>Characterization |
|---|---|
| 1 | Hard, white shining, tarnish-resistant, non-marring coatings |
| 2 | same as Example 1 |
| 3 | same as Example 1 |
| C1 | Hard coatings, some burn marks, readily marred |
| C2 | same as Example C1 |
| 4 | Hard, white shining, tarnish-resistant, non-marring coatings |
| C3 | Mat, white, non-tarnish-resistant coatings |
| 5 | Hard, white shining, tarnish-resistant, non-marring coatings |
| 6 | same as Example 5 |
| C4 | Mat, partially clouded, readily marred coatings |
| 7 | Hard, white shining, tarnish-resistant, non-marring coatings |
| C5 | Milky, readily marred coatings |
| 8 | Hard, white shining, tarnish-resistant, non-marring coatings |
| 9 | same as Example 8 |

Note: [a]Examples preceded by "C"are Comparison Examples
B: Examples 7 to 9 and Comparison Example C5.

B: Examples 7 to 9 and Comparison Example C5

Electrodeposition baths containing the coponents indicated in Table 1 in the quantities indicated were prepared. A solution having the following composition:

12.5% by weight of formaldehyde
0.5% by weight of sodium o-benzoyl sulfimide
12.5% by weight of i-nonyl sulfate
74.5% by weight of water was added to these electroplating baths as shine promotor in the quantities indicated in Table 1. The cathode plates used were polished brass plates which were mechanically moved back and forth (in Examples 7 and C5). In Examples 8 and 9 , the electrolyte bath was agitated by the injection of air.

The anode materials used were high-purity nickel and cobalt in titanium baskets with anode bags.

The brass plates were electroplated in known manner for 10 minutes at a temperature of 55° to 60° C. and at the current density indicated in Table 1.

The coatings deposited on the plates are characterized in Table 2.

What is claimed is:

1. A process for the electrodeposition of hard, tarnish resistant, white shining, nickel and cobalt containing coatings comprising the steps of A. forming an aqueous electrodeposition bath comprising:

a. a nickel ion content of from about 15 to about 150 g/l, b. a cobalt ion content of from about 0.5 to about 15 g/l, c. a chloride ion content of from about 5.0 to about 25.0 g/l, d. a boric acid content of from about 20 to about 40 g/l, e. an aliphatic $C_1$–$C_4$ aldehyde content of from about 0.1 to about 1 g/l, and f. an aromatic water-soluble carbonyl compound content of from about 0.005 to about 0.05 g/l, wherein the pH of the bath is from about 3.6 to about 4.8, the ratio of nickel ions to cobalt ions is from about 8:1 to about 20:1, and the ratio of aldehyde to carbonyl compound is from about 20:1 to about 50:1; and B. treating a substrate to be electrocoated with the aqueous electrocoating bath formed in A above at a temperature of from about 40° to about 60° C. and a cathodic current density of up to 7 $A.dm^{-2}$ using as the anode nickel metal, and optionally cobalt metal in a weight ratio of nickel to cobalt of from about 5:1 to about 10:1.

2. A process in accordance with claim 1 wherein in step A. the bath contains from about 36.0 to about 93.3 g/l of nickel ions, from about 1.7 to about 11.5 g/l of cobalt ions, and from about 8.0 to about 12.0 g/l of chloride ions.

3. A process in accordance with claim 2 wherein in step A. about 30 g/l of boric acid are present in the bath.

4. A process in accordance with claim 1 wherein in step A. about 30 g/l of boric acid are present in the bath.

5. A process in accordance with claim 1 wherein in step A. component e. is formaldehyde and component f. is N-acetyl-o-benzoyl sulfimide.

6. A process in accordance with claim 1 wherein the pH of the bath in step A. is from about 4.0 to about 4.4.

7. A process in accordance with claim 1 wherein step B. is carried out at a temperature of from about 50° to about 55° C.

8. A process in accordance with claim 1 wherein the anode in step B. comprises pieces of metallic nickel and metallic cobalt in a weight ratio of from about 5:1 to about 10:1 in titanium baskets with anode bags.

9. A process in accordance with claim 1 wherein in A. the bath also contains from about 0.1 to about 20 g/l of a wetting agent.

10. A process in accordance with claim 9 wherein the wetting agent is a $C_8$–$C_{18}$ alkyl sulfate or a $C_8$–$C_{18}$ alkyl ether sulfate containing from 2 to 6 alkylene oxide groups.

11. A process in accordance with claim 9 wherein the wetting agent is either isononyl sulfate or sodium lauryl ether sulfate.

12. A process in accordance with claim 1 wherein in step B. the cobalt metal has a purity of at least 99.9%.

13. An aqueous electrodeposition bath for the electrodeposition of hard, tarnish resistant, white shining, nickel and cobalt containing coatings comprising a. a nickel ion content of from about 15 to about 150 g/l, b. a cobalt ion content of from about 0.5 to about 15 g/l, c. a chloride ion content of from about 5.0 to about 25.0 g/l, d. a boric acid content of from about 20 to about 40 g/l, e. an aliphatic $C_1$–$C_4$ aldehyde content of from about 0.1 to about 1 g/l, and f. an aromatic water-soluble carbonyl compound content of from about 0.005 to about 0.05 g/l, wherein the pH of the bath is from about 3.6 to about 4.8, the ratio of nickel ions to cobalt ions is from about 8:1 to about 20:1, and the ratio of aldehyde to carbonyl compound is from about 20:1 to about 50:1.

14. An aqueous electrodeposition bath in accordance with claim 13 wherein from about 36.0 to about 93.3 g/l of nickel ions, from about 1.7 to about 11.5 g/l of cobalt ions, and from about 8.0 to about 12.0 g/l of chloride ions are present therein.

15. An aqueous electrodeposition bath in accordance with claim 14 wherein about 30 g/l of boric acid are present therein.

16. An aqueous electrodeposition bath in accordance with claim 13 wherein about 30 g/l of boric acid are present therein.

17. An aqueous electrodeposition bath in accordance with claim 13 wherein component e. is formaldehyde and component f. is N-acetyl-o-benzoyl sulfimide.

18. An aqueous electrodeposition bath in accordance with claim 13 wherein the pH of the bath is from about 4.0 to about 4.4.

19. An aqueous electrodeposition bath in accordance with claim 13 wherein the bath also contains from about 0.1 to about 20 g/l of a wetting agent.

20. An aqueous electrodeposition bath in accordance with claim 19 wherein the wetting agent is a $C_8$–$C_{18}$ alkyl sulfate or a $C_8$–$C_{18}$ alkyl ether sulfate containing from 2 to 6 alkylene oxide groups.

21. An aqueous electrodeposition bath in accordance with claim 19 wherein the wetting agent is either isononyl sulfate or sodium lauryl ether sulfate.

* * * * *